US010816150B1

(12) United States Patent
Hsu

(10) Patent No.: US 10,816,150 B1
(45) Date of Patent: Oct. 27, 2020

(54) LAMP ASSEMBLY THAT IS ADAPTED TO ASSEMBLE CEILING FITTING AND RECESSED LIGHT EASILY AND QUICKLY

(71) Applicant: Dong Guan Jia Sheng Lighting Technology Co., Ltd. China, Dong-Guna, Guang-Dong (CN)

(72) Inventor: Kevin Hsu, Taichung (TW)

(73) Assignee: Dong Guan Jia Sheng Lighting Technology Co., Ltd. China, Guang-Dong (CN)

( * ) Notice: Subject to any disclaimer, the term of this patent is extended or adjusted under 35 U.S.C. 154(b) by 0 days.

(21) Appl. No.: 16/662,201

(22) Filed: Oct. 24, 2019

(51) Int. Cl.

| | |
|---|---|
| ***F21S 8/04*** | (2006.01) |
| ***F21V 15/01*** | (2006.01) |
| ***F21V 17/12*** | (2006.01) |
| ***F21S 8/02*** | (2006.01) |
| *F21Y 115/10* | (2016.01) |

(52) U.S. Cl.
CPC ..... *F21S 8/043* (2013.01); *F21S 8/026* (2013.01); *F21V 15/01* (2013.01); *F21V 17/12* (2013.01); *F21Y 2115/10* (2016.08)

(58) Field of Classification Search
CPC ..... F21S 8/043; F21S 8/026; F21V 15/01; F21V 17/12; F21V 2115/10; F21Y 2115/10
See application file for complete search history.

(56) References Cited

U.S. PATENT DOCUMENTS 9,945,533 B1 * 4/2018 Orbe ..... F21V 3/00
2011/0273877 A1 * 11/2011 Reed ..... F21S 2/005 362/235
2013/0242575 A1 * 9/2013 Horng ..... F21V 29/677 362/373
2013/0279200 A1 * 10/2013 Kang ..... G02B 6/0068 362/613
2016/0348861 A1 * 12/2016 Bailey ..... F21V 23/006
2018/0128434 A1 * 5/2018 Moon ..... F21V 23/005

FOREIGN PATENT DOCUMENTS

CN 208431650 U * 1/2019

OTHER PUBLICATIONS

Machine English Translation of CN208431650U, Huang, Jan. 2019 (Year: 2019).*

* cited by examiner

*Primary Examiner* — Isiaka O Akanbi
*Assistant Examiner* — Glenn D Zimmerman
(74) *Attorney, Agent, or Firm* — Alan D. Kamrath; Karin L. Williams; Mayer & Williams PC

(57) ABSTRACT

A lamp assembly includes a top disk, a shell, a fitting unit, a light output board, a lighting device, a light shading board, and a light permeable board. The top disk is mounted on the top of the shell. The light output board is mounted on the bottom of the shell. A receiving space is defined between the shell, the top disk, and the light output board, for receiving the lighting device, the light shading board, and the light permeable board. The fitting unit is mounted on the top disk, and includes a mounting bracket and at least one mounting mechanism. One of the mounting bracket and the at least one mounting mechanism is selectively mounted on the top disk. Thus, the lamp assembly is adapted to function as a ceiling fitting or a recessed light.

9 Claims, 6 Drawing Sheets

LAMP ASSEMBLY THAT IS ADAPTED TO ASSEMBLE CEILING FITTING AND RECESSED LIGHT EASILY AND QUICKLY

BACKGROUND OF THE INVENTION

1. Field of the Invention

The present invention relates to an illuminating tool and, more particularly, to a lamp assembly.

2. Description of the Related Art

A conventional ceiling fitting is mounted on the ceiling to provide a lighting function. The conventional ceiling fitting includes a base, a lamp socket, a shell, and a light source. A conventional recessed light is mounted on the wall (or ceiling) to provide a lighting function. However, the ceiling fitting and the recessed light only have a single mounting manner and cannot be exchanged, thereby limiting the versatility of the ceiling fitting and the recessed light.

BRIEF SUMMARY OF THE INVENTION

The primary objective of the present invention is to provide a lamp assembly that is adapted to assemble a ceiling fitting and a recessed light easily and quickly.

In accordance with the present invention, there is provided a lamp assembly comprising a top disk, a shell, a fitting unit, a light output board, a lighting device, a light shading board, and a light permeable board. The top disk is mounted on a top of the shell. The light output board is mounted on a bottom of the shell. A receiving space is defined between the shell, the top disk, and the light output board. The lighting device is mounted in the receiving space. The lighting device has an annular arrangement and has an outer face abutting the shell, and an inner face surrounding the light permeable board. The light shading board is mounted in the receiving space, and is located above the light permeable board. The light permeable board is mounted in the receiving space, and is located above and spaced from the light output board. The fitting unit is mounted on a top of the top disk, and includes a mounting bracket and at least one mounting mechanism. One of the mounting bracket and the at least one mounting mechanism is mounted on the top disk.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
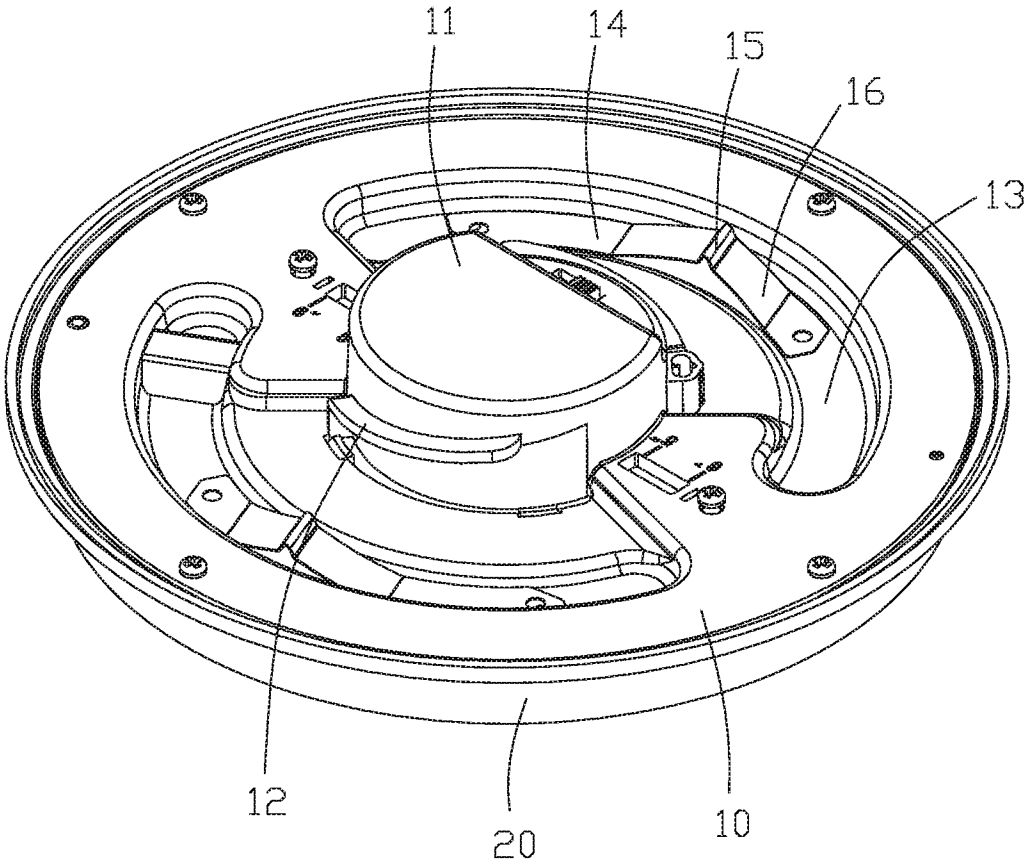
FIG. 1 is a partial perspective view of a lamp assembly in accordance with the preferred embodiment of the present invention.
Figure 2:
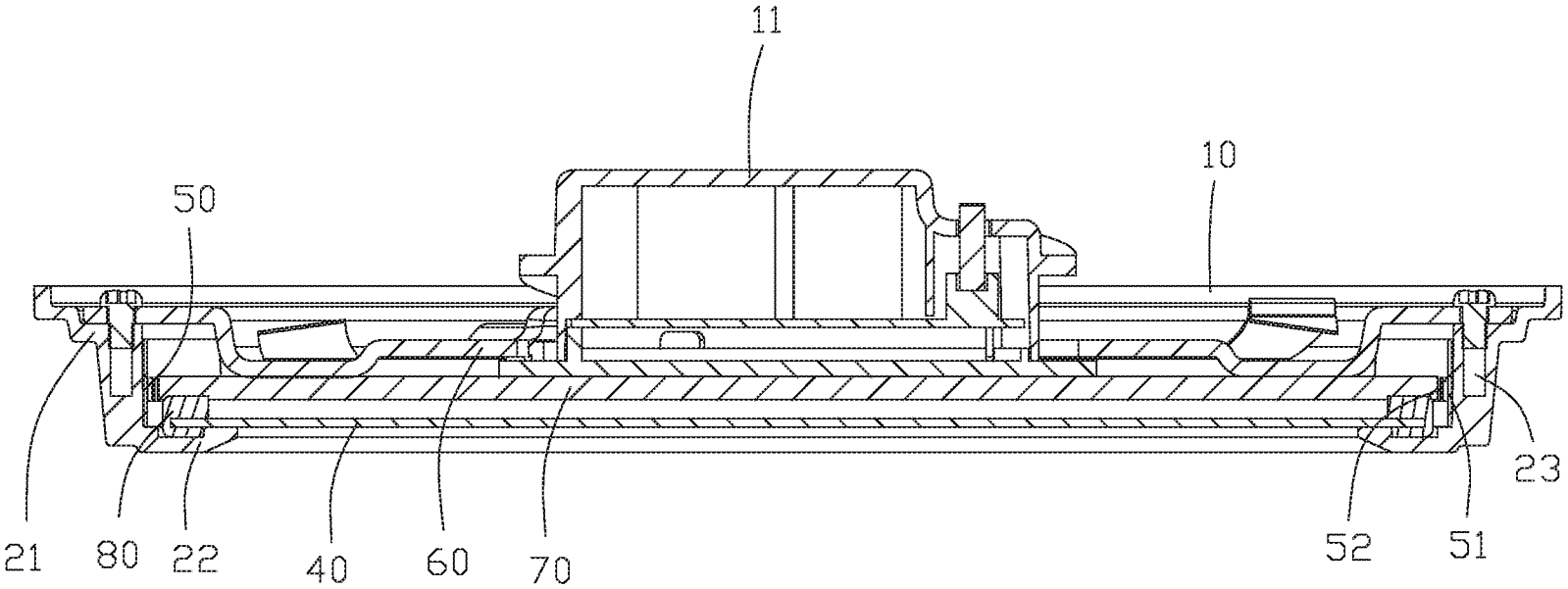
FIG. 2 is a cross-sectional view of the lamp assembly in accordance with the preferred embodiment of the present invention.

Referring to the drawings and initially to FIGS. 1-6, a lamp assembly in accordance with the preferred embodiment of the present invention comprises a top disk 10, a shell 20, a fitting unit, a light output board 40, a lighting device (or light source) 50, a light shading board 60, and a light permeable board 70.

The top disk 10 is mounted on a top of the shell 20. The light output board 40 is mounted on a bottom of the shell 20. A receiving space is defined between the shell 20, the top disk 10, and the light output board 40. The lighting device 50 is mounted in the receiving space. The lighting device 50 has an annular arrangement and has an outer face abutting the shell 20, and an inner face surrounding the light permeable board 70. The light shading board 60 is mounted in the receiving space, and is located above the light permeable board 70. The light shading board 60 is arranged between the light permeable board 70 and the top disk 10. The light permeable board 70 is mounted in the receiving space, and is located above and spaced from the light output board 40. The fitting unit is mounted on a top of the top disk 10, and includes a mounting bracket 31 and at least one mounting mechanism 32. Preferably, the fitting unit includes two mounting mechanisms 32 which are arranged symmetrically. One of the mounting bracket 31 and the at least one mounting mechanism 32 is mounted on the top disk 10.

In the preferred embodiment of the present invention, the at least one mounting mechanism 32 includes an elastic member 33, an upper securing plate 34, a lower securing plate 35, and a fastening member 90. The upper securing plate 34 is mounted on a top of the top disk 10, and the lower securing plate 35 is mounted on a bottom of the top disk 10, such that the top disk 10 is sandwiched between the upper securing plate 34 and the lower securing plate 35. The fastening member 90 in turn extends through the upper securing plate 34, the top disk 10, and the lower securing plate 35, to lock the upper securing plate 34, the top disk 10, and the lower securing plate 35. The elastic member 33 is mounted on the upper securing plate 34. The upper securing plate 34 has an L-shaped configuration.

In the preferred embodiment of the present invention, the elastic member 33 has a V-shaped configuration, and has two ends each provided with a hanging hook 331. The elastic member 33 has a middle mounted on the upper securing plate 34.

In the preferred embodiment of the present invention, two elastic locking plates 14 are mounted on the top disk 10. The top disk 10 is provided with a projection 11 located between the two elastic locking plates 14. The projection 11 is a cylindrical platform and is provided with two retaining ribs 12. The mounting bracket 31 has two ends each provided with a mounting portion 311 clamped between one of the two retaining ribs 12 and one of the two elastic locking plates 14. The mounting portion 311 extends outward from each of the two ends of the mounting bracket 31.

In the preferred embodiment of the present invention, the top disk 10 is provided with two arcuate slots 13, and the two elastic locking plates 14 are detachably mounted in the two arcuate slots 13 of the top disk 10. Preferably, the two elastic locking plates 14 are locked on the top disk 10 by screws. In the preferred embodiment of the present invention, each of the two retaining ribs 12 is an arcuate elongate strip and has a first end provided with an entrance and a second end provided with a limit portion. Each of the two retaining ribs 12 is gradually inclined downward from the entrance to the limit portion.

In the preferred embodiment of the present invention, the limit portion of each of the two retaining ribs 12 is provided with a stop plate 17.

In the preferred embodiment of the present invention, each of the two elastic locking plates 14 is provided with two oblique guide faces 16 and a pointed pressing portion 15 located between the two oblique guide faces 16. The pointed pressing portion 15 is higher than other part of each of the two elastic locking plates 14.

In the preferred embodiment of the present invention, the mounting bracket 31 has an inverted U-shaped configuration. The mounting portion 311 of a first end of the mounting bracket 31 presses one of the two elastic locking plates 14 and is provided with at least one elastic piece 312 pressing one of the two retaining ribs 12. The at least one elastic piece 312 has an oblique shape and is gradually inclined upward from the first end of the mounting bracket 31. The mounting portion 311 of a second end of the mounting bracket 31 presses the other one of the two elastic locking plates 14 and is provided with at least one extension piece 313 pressing the other one of the two retaining ribs 12. The at least one extension piece 313 is arranged horizontally.

In the preferred embodiment of the present invention, the shell 20 has a hollow annular arrangement. The shell 20 has an upper inner face provided with a first retaining portion 21, and the top disk 10 is mounted on and limited by the first retaining portion 21.

In the preferred embodiment of the present invention, the shell 20 has a lower inner face provided with a second retaining portion 22, and the light output board 40 is mounted on and limited by the second retaining portion 22. The second retaining portion 22 is provided with a retaining groove. A gasket 80 is mounted in the retaining groove of the second retaining portion 22. The light output board 40 has a periphery inserted into the gasket 80. The light permeable board 70 is mounted on a top of the gasket 80. Thus, the gasket 80 separates the light permeable board 70 from the light output board 40. Preferably, the gasket 80 is provided with a mounting groove for mounting the light output board 40.

In the preferred embodiment of the present invention, the shell 20 has a hollow interior. The top of the shell 20 is provided with a plurality of recesses 23 extending downward. The shell 20 is provided with a partition located between the hollow interior and the recesses 23. The lighting device 50 is mounted in the partition of the shell 20. A plurality of screw members extend through the top disk 10 and the light shading board 60, and are screwed into the recesses 23 of the shell 20, to lock the top disk 10 and the light shading board 60 on the shell 20.

In the preferred embodiment of the present invention, the lighting device 50 includes an annular LED circuit board 51, and a plurality of light emitting members 52 mounted on the LED circuit board 51. The LED circuit board 51 has an outer face abutting the shell 20.

Figure 3:
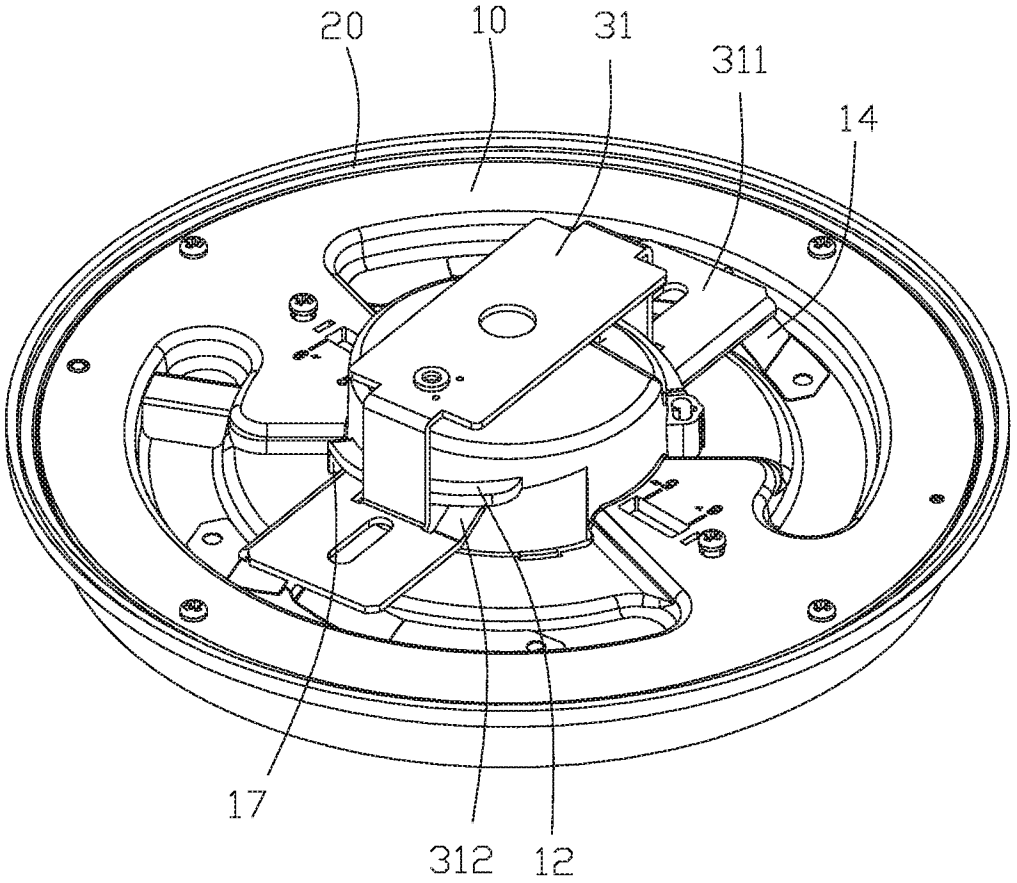
FIG. 3 is a perspective view showing the lamp assembly functions as a ceiling fitting.
Figure 4:
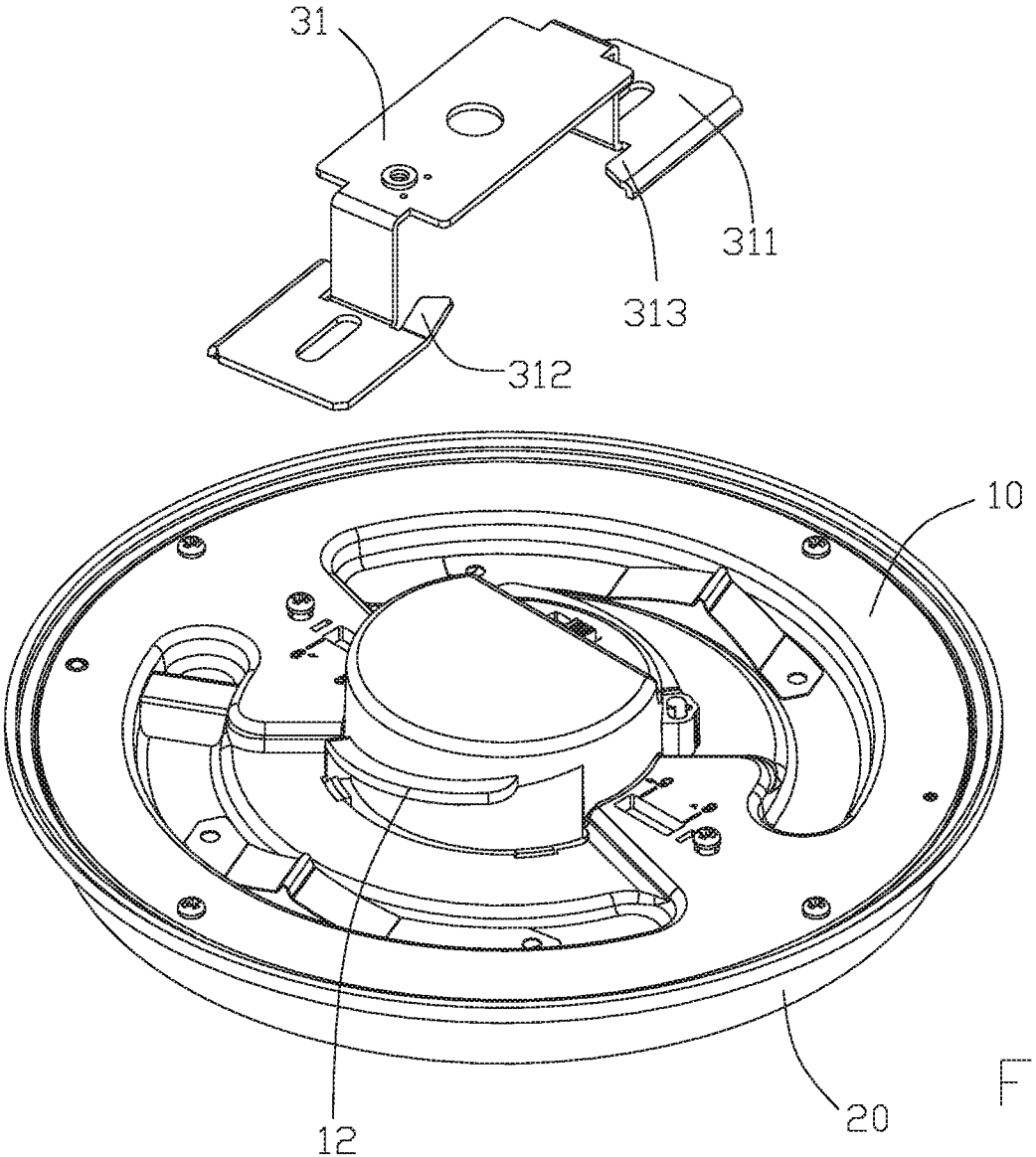
FIG. 4 is a partial exploded perspective view of the lamp assembly as shown in FIG. 3.

In assembly, the mounting bracket 31 is initially secured to the ceiling. Then, the top disk 10 is mounted on the mounting bracket 31, and the shell 20 is rotated relative to the mounting bracket 31. When the shell 20 is rotated relative to the mounting bracket 31, the at least one elastic piece 312 and the at least one extension piece 313 of the mounting bracket 31 gradually extend from the entrance to the limit portion of each of the two retaining ribs 12 of the top disk 10, such that the two retaining ribs 12 of the top disk 10 are locked by the at least one elastic piece 312 and the at least one extension piece 313 of the mounting bracket 31. At the same time, the pointed pressing portion 15 of each of the two elastic locking plates 14 is pressed by the mounting portion 311 of the mounting bracket 31. In such a manner, the top disk 10 is locked onto the mounting bracket 31 by the two retaining ribs 12 and the two elastic locking plates 14 as shown in FIG. 3, such that the lamp assembly is attached to the ceiling by the mounting bracket 31. Thus, the lamp assembly is adapted to function as a ceiling fitting.

Figure 5:
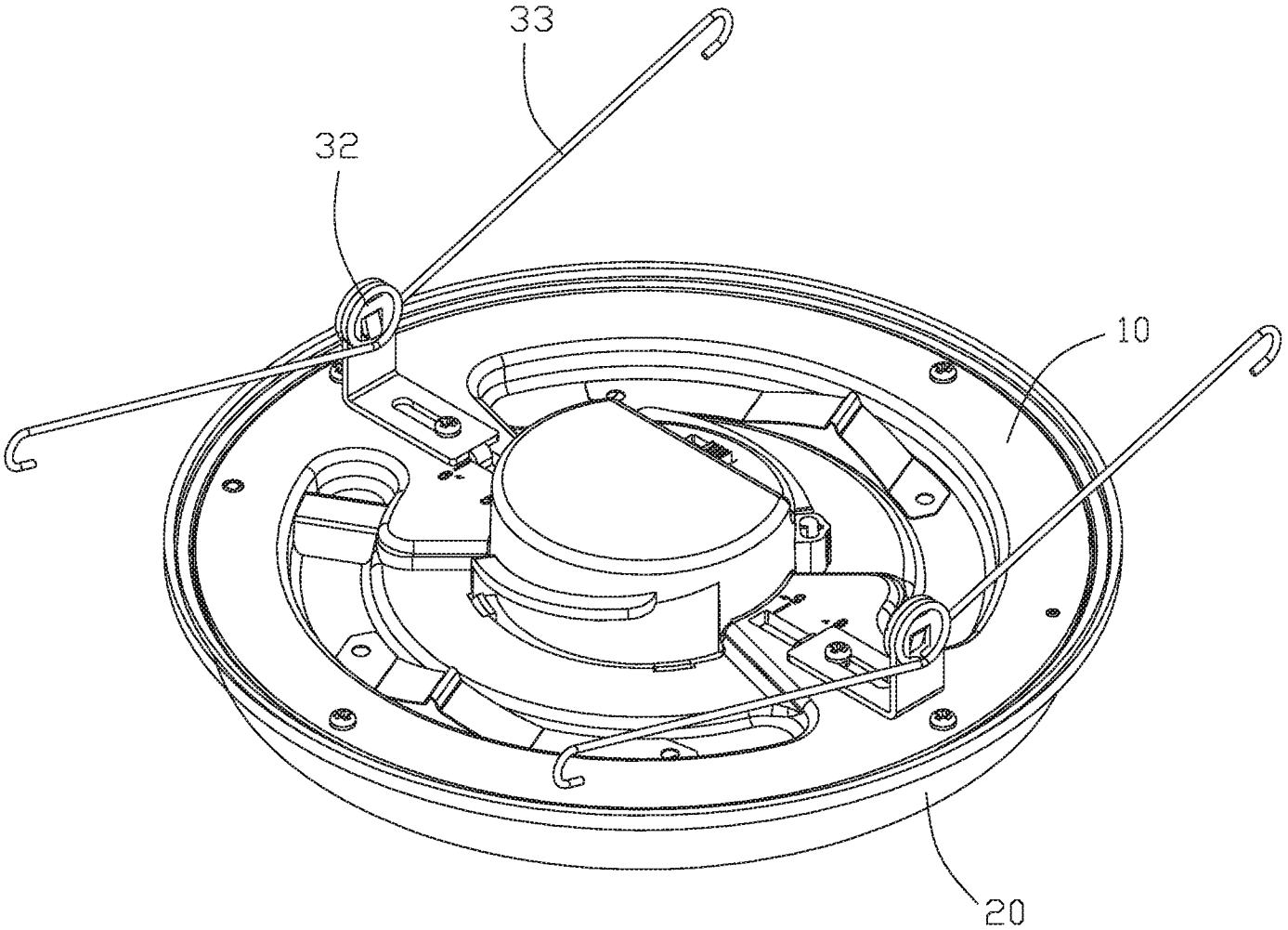
FIG. 5 is a perspective view showing the lamp assembly functions as a recessed light.
Figure 6:
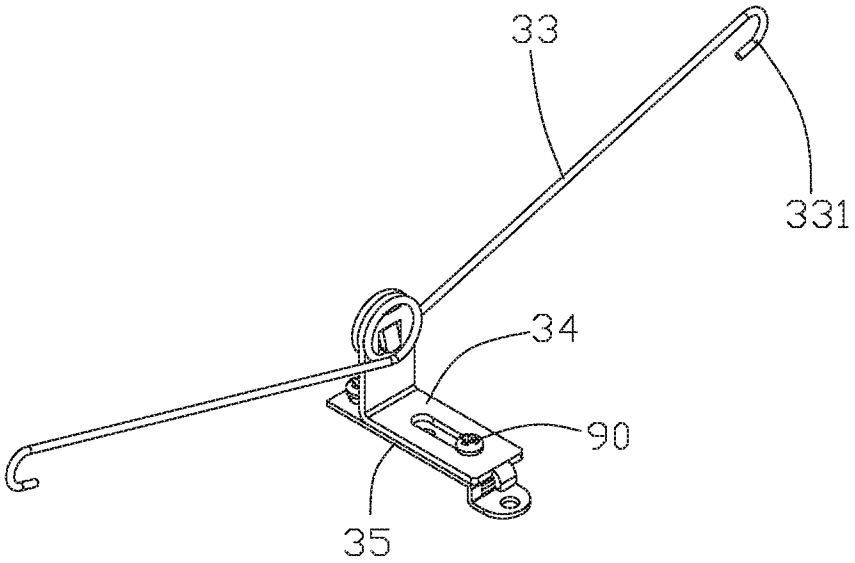
FIG. 6 is a perspective view of a mounting mechanism of the lamp assembly in accordance with the preferred embodiment of the present invention.

Alternatively, the lower securing plate 35 is initially secured to the bottom of the top disk 10 by screws, and the elastic member 33 is initially mounted on the upper securing plate 34. Then, the upper securing plate 34 is mounted on the top of the top disk 10, and the fastening member 90 extends through the upper securing plate 34, the top disk 10, and the lower securing plate 35, to lock the upper securing plate 34, the top disk 10, and the lower securing plate 35. In such a manner, the at least one mounting mechanism 32 is mounted on the top disk 10 as shown in FIG. 5. Thus, the lamp assembly is adapted to function as a recessed light. Then, the elastic member 33 is inserted into a slot of a wall. Then, the elastic member 33 is pressed and stretched into a flat state, such that the hanging hook 331 of the elastic member 33 is hooked onto a locking member in the slot of the wall. Thus, the lamp assembly is attached to the wall. In such a manner, the lamp assembly is thin so that the dimension of the slot of the wall is reduced.

Accordingly, the lamp assembly is adapted to function as a ceiling fitting or a recessed light according to the practical requirement, thereby enhancing the versatility of the lamp assembly. In addition, the lamp assembly is adapted to assemble a ceiling fitting or a recessed light easily, quickly and conveniently, thereby facilitating the user mounting the lamp assembly.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A lamp assembly comprising:

a top disk, a shell, a fitting unit, a light output board, a lighting device, a light shading board, and a light permeable board;

wherein:

the top disk is mounted on a top of the shell;

the light output board is mounted on a bottom of the shell;

a receiving space is defined between the shell, the top disk, and the light output board;

the lighting device is mounted in the receiving space;

the lighting device has an annular arrangement and has an outer face abutting the shell, and an inner face surrounding the light permeable board;

the light shading board is mounted in the receiving space, and is located above the light permeable board;

the light permeable board is mounted in the receiving space, and is located above and spaced from the light output board;

the fitting unit is mounted on a top of the top disk, and includes a mounting bracket and at least one mounting mechanism;

one of the mounting bracket and the at least one mounting mechanism is mounted on the top disk;

the at least one mounting mechanism includes an elastic member, an upper securing plate, a lower securing plate, and a fastening member;

the upper securing plate is mounted on a top of the top disk, and the lower securing plate is mounted on a bottom of the top disk, with the top disk being sandwiched between the upper securing plate and the lower securing plate;

the fastening member in turn extends through the upper securing plate, the top disk, and the lower securing plate; and the elastic member is mounted on the upper securing plate.

2. A lamp assembly comprising:

a top disk, a shell, a fitting unit, a light output board, a lighting device, a light shading board, and a light permeable board;

wherein:

the top disk is mounted on a top of the shell;

the light output board is mounted on a bottom of the shell;

a receiving space is defined between the shell, the top disk, and the light output board;

the lighting device is mounted in the receiving space;

the lighting device has an annular arrangement and has an outer face abutting the shell, and an inner face surrounding the light permeable board;

the light shading board is mounted in the receiving space, and is located above the light permeable board;

the light permeable board is mounted in the receiving space, and is located above and spaced from the light output board;

the fitting unit is mounted on a top of the top disk, and includes a mounting bracket and at least one mounting mechanism; and one of the mounting bracket and the at least one mounting mechanism is mounted on the top disk;

two elastic locking plates are mounted on the top disk;

the top disk is provided with a projection located between the two elastic locking plates;

the projection is provided with two retaining ribs; and the mounting bracket has two ends each provided with a mounting portion clamped between one of the two retaining ribs and one of the two elastic locking plates.

3. A lamp assembly comprising:

a top disk, a shell, a fitting unit, a light output board, a lighting device, a light shading board, and a light permeable board;

wherein:

the top disk is mounted on a top of the shell;

the light output board is mounted on a bottom of the shell;

a receiving space is defined between the shell, the top disk, and the light output board;

the lighting device is mounted in the receiving space;

the lighting device has an annular arrangement and has an outer face abutting the shell, and an inner face surrounding the light permeable board;

the light shading board is mounted in the receiving space, and is located above the light permeable board;

the light permeable board is mounted in the receiving space, and is located above and spaced from the light output board;

the fitting unit is mounted on a top of the top disk, and includes a mounting bracket and at least one mounting mechanism; and one of the mounting bracket and the at least one mounting mechanism is mounted on the top disk;

the shell has a hollow interior;

the top of the shell is provided with a plurality of recesses extending downward;

the shell is provided with a partition located between the hollow interior and the recesses; and the lighting device is mounted in the partition of the shell.

4. The lamp assembly of claim 1, wherein:

the elastic member has a V-shaped configuration, and has two ends each provided with a hanging hook; and the elastic member has a middle mounted on the upper securing plate.

5. The lamp assembly of claim 1, wherein:

the shell has a hollow annular arrangement;

the shell has an upper inner face provided with a first retaining portion; and the top disk is mounted on and limited by the first retaining portion.

6. The lamp assembly of claim 2, wherein:

each of the two retaining ribs is an elongate strip and has a first end provided with an entrance and a second end provided with a limit portion; and each of the two retaining ribs is gradually inclined downward from the entrance to the limit portion.

7. The lamp assembly of claim 2, wherein each of the two elastic locking plates is provided with two oblique guide faces and a pointed pressing portion located between the two oblique guide faces, and the pointed pressing portion is higher than other part of each of the two elastic locking plates.

8. The lamp assembly of claim 2, wherein:

the mounting bracket has an inverted U-shaped configuration;

the mounting portion of a first end of the mounting bracket presses one of the two elastic locking plates and is provided with at least one elastic piece pressing one of the two retaining ribs;

the at least one elastic piece has an oblique shape and is gradually inclined upward from the first end of the mounting bracket; and the mounting portion of a second end of the mounting bracket presses the other one of the two elastic locking plates and is provided with at least one extension piece pressing the other one of the two retaining ribs.

9. The lamp assembly of claim 5, wherein:

the shell has a lower inner face provided with a second retaining portion;

the light output board is mounted on and limited by the second retaining portion;

the second retaining portion is provided with a retaining groove;

a gasket is mounted in the retaining groove of the second retaining portion;

the light output board has a periphery inserted into the gasket; and the light permeable board is mounted on a top of the gasket.

* * * * *